US005822674A

United States Patent [19]

Behrens et al.

[11] Patent Number: 5,822,674

[45] Date of Patent: Oct. 13, 1998

[54] ELECTRICAL CONTACT MATERIAL AND METHOD OF MAKING THE SAME

[75] Inventors: Volker Behrens, Bretten; Thomas Honig, Tiefenbronn, both of Germany

[73] Assignee: Doduco GmbH + Co. Dr. Eugen Durrwachter, Pforzheim, Germany

[21] Appl. No.: 397,149

[22] PCT Filed: Sep. 16, 1993

[86] PCT No.: PCT/EP93/02511

§ 371 Date: May 18, 1995

§ 102(e) Date: May 18, 1995

[87] PCT Pub. No.: WO94/07252

PCT Pub. Date: Mar. 31, 1994

[30] Foreign Application Priority Data

Sep. 16, 1992 [DE] Germany ..... 42 31 022.9

[51] Int. Cl.[6] ..... B22F 3/12; B22F 3/16; C22C 1/05; C22C 5/06

[52] U.S. Cl. ..... 419/21; 419/29; 419/30; 419/45; 419/46; 419/53; 75/234; 75/247; 428/552; 428/558; 428/559; 428/565

[58] Field of Search ..... 428/548, 551, 428/552, 558, 559, 564, 565; 419/21, 29, 30, 35, 45, 46, 53; 75/234, 235, 246, 247

[56] References Cited

U.S. PATENT DOCUMENTS

| | | | |
|---|---|---|---|
| 3,685,134 | 8/1972 | Blue | 29/420.5 |
| 3,954,459 | 5/1976 | Schreiner et al. | 75/206 |
| 4,141,727 | 2/1979 | Shida et al. | 75/232 |
| 4,204,863 | 5/1980 | Schreiner | 75/234 |
| 4,330,330 | 5/1982 | Bohm | 148/430 |
| 4,341,556 | 7/1982 | Bohm et al. | 75/173 A |
| 4,410,491 | 10/1983 | Wolfgang et al. | 420/501 |
| 4,551,301 | 11/1985 | Schreiner | 419/21 |
| 4,609,525 | 9/1986 | Schreiner et al. | 419/6 |
| 4,764,227 | 8/1988 | Rothkegel et al. | 148/431 |
| 4,980,125 | 12/1990 | Haufe et al. | 419/21 |
| 5,160,366 | 11/1992 | Shibata | 75/232 |
| 5,360,673 | 11/1994 | Mayer et al. | 428/546 |

FOREIGN PATENT DOCUMENTS

| | | | |
|---|---|---|---|
| 0056857 | 12/1981 | European Pat. Off. . | |
| 0369283 | 11/1989 | European Pat. Off. . | |
| 2659012 | 12/1976 | Germany . | |
| 2933338 | 8/1979 | Germany . | |
| 2952128 | 12/1979 | Germany . | |
| 3102067 | 1/1981 | Germany . | |
| 3232627 | 9/1982 | Germany . | |
| 8001434 | 7/1980 | WIPO | 73/64.4 |
| 8909478 | 3/1988 | WIPO . | |

OTHER PUBLICATIONS

Bourda et al, "Properties and Effects of Doping Agents Used in $AgSnO_2$ Contact Materials", Proceedings on the 16$^{th}$ International Conference on Electric Contacts, Sep. 7–12, 1992, pp. 377–382.

Manhart et al, "Lichtbogenbewegung auf Kontaktwerkstoffen aus AgMeO unter Berücksichtigung der Gebrauchskategorien von Schützen", pp. 49–53, Jan., 1987.

Lübcke et al, "Mehrkomponentenwerkstoffe auf der Basis Ag–MeO als Kontaktmaterial für Niederspannungsschaltgeräte", Metallwissenschaft & Technik, pp. 654–658, Jul., 1990.

*Primary Examiner*—Kathryn L. Gorgos
*Assistant Examiner*—Chrisman D. Carroll
*Attorney, Agent, or Firm*—Dvorak & Orum

[57] ABSTRACT

A material for electric contacts based on silver-tin oxide is obtained by mixing a powder of silver or an alloy mainly containing silver with a powder consisting mainly of tin oxide and 0.01 to 10 wt. % (in relation to the quantity of tin oxide) of an additive consisting of one or more compounds containing silver, oxygen and a metal from sub-groups II to VI of the periodic system and/or antimony, bismuth, germanium, indium and gallium, compacting the mixture and sintering it. The tin oxide may be replaced by zinc oxide.

10 Claims, No Drawings

ELECTRICAL CONTACT MATERIAL AND METHOD OF MAKING THE SAME

This is a national stage application of PCT/EP93/02511, filed Sep. 16, 1993.

BACKGROUND OF THE INVENTION

1. Field of the Invention

The invention comprises a material for electric contacts based on silver-tin oxide 2. Description of the Prior Art Contact materials based on silver-tin oxide have begun to replace the hitherto preferred silver-cadmium oxide materials because the former are environment friendlier and generally have a longer life span. Their thermal behavior is, however, unsatisfactory, since tin oxide, when subjected to continuous current, has a tendency to produce poorly conductive slag layers on the contact surface, influenced by electric arc. In order to overcome this disadvantage, it is known that admixtures, added in powder form to the powder metallurgically produced material, bring about a temperature reduction at the contact. Suitable admixtures in this sense have been mentioned in the patent literature, especially tungsten- and molybdenum-oxide and molybdenum carbide (DE-A-29 33 338, DE-A-31 02 067, DE-A-32 32 627). Further suitable admixtures such as bismuth- and germanium-oxides have been mentioned (DE-A-31 02 067 and DE-A-32 32 627). These admixtures help wet tin oxide particles so that when the contact area melts locally under the action of electric arc, tin oxide remains suspended in fine particles. Apart from this favorable thermal behavior under continuous current, theses admixtures have also unfavorable side effects. The already somewhat unsatisfactory plastic deformation behavior, i. e. brittleness, of silver-tin oxide contact materials, which can be improved, for example, by annealing the tin oxide powder (DE-A-29 52 128), is worsened by these admixtures, since they promote embrittlement. This is particularly true for bismuth and molybdenum oxide. A further disadvantage, especially of the tungsten and molybdenum compounds, is the fact that they tend to transfer material, especially during switching operations under AC1-loads (DIN 57660, Part 102), resulting in accelerated burning off and therefore reduced life span.

According to the teaching of WO 89/09478, a contact material with low welding tendency and minimal contact temperature under continuous current can be obtained by creating a structure containing regions with little or no metal oxides, alternating with regions containing the majority of metal oxides, finely dispersed. For this purpose a powdered compound, among other means, is commercially available, containing the predominant portion of tin oxides and the other oxides and/or carbides as well as a portion of the silver. This compound powder is combined with the remaining silver powder, and with the smaller remaining portion of metal oxides, mixed, condensed, sintered and transformed. In this manner a useful material is obtained but through a relatively costly process. Mentioned metal oxides are tungsten, molybdenum, bismuth, vanadium and copper.

From the paper by Christine Bourda et al. "Properties and effects of doping agents in AGSNO2contact materials", published in Proc. 16th Int. Conference on Electrical Contacts 7.-Sep. 12, 1992 in Loughborough, it is known that many admixtures made up of oxides react with silver or tin oxide; for example it was found that in a contact material produced from silver powder, tin oxide powder and molybdenum oxide powder or antimony oxide powder, at temperatures reached during electric arcing, silver and molybdenum oxide can combine into silver molybdate $Ag_2MoO_4$, and silver and antimony oxide can combine into silver antimonate $AgSbO_3$. As to these admixtures, the bibliographical reference indicates that, according to results of tests, they do not influence the wetability of tin oxide and silver, so that they are not expected to improve the temperature behavior of contacts under continuous current.

In the older but not pre-published German patent application P 42 19 333.8, a material for electric contacts had already been proposed on the basis of silver-tin oxide which is obtained through mixing of a powder of silver or of a principally silver containing alloy with a tin oxide powder, whose powder particles are doped with up to 5 weight % of an oxide or carbide of molybdenum, tungsten, bismuth, antimony, germanium, vanadium, copper or indium, condensing the mixture, sintering and transforming it. The doped tin oxide powder is a compound powder which can be obtained through mixing tin oxide powder with the powdered doping agent, annealing the mixture, so that the doping agent diffuses into the tin oxide powder particles, and segregating the surplus of the doping agent from the tin oxide powder. A further process for obtaining doped tin oxide powder is made known in P 42 19 333.8. A solution of a salt of tin and of a salt of the metal or metals, whose oxides or carbides make up the doping agent, is sprayed into a hot oxidizing atmosphere in which the salts are to be decomposed so that a fine-grained compound powder precipitates whose particles contain tin oxide and the doping agent.

SUMMARY OF THE INVENTION

The purpose of the present invention is to create a material of the kind described at the beginning which, through use of admixtures exhibits an equally favorable thermal behavior as the already known materials do, but which is more ductile and has a longer life time when subjected to the AC1 switching load case. This task is solved by a material with characteristics described in claim 1. A particularly suitable process for producing such a material is the subject of claim 9. Favorable further developments of the invention are subject of dependent claims.

In the powder metallurgical production of a contact material on the basis of silver-tin oxide, the invention additionally utilizes a powder containing one or more chemical compounds of silver, oxygen and a metal from subgroups II to VI and/or antimony, bismuth, germanium, gallium and indium, especially silver-tungsten-oxygen compounds, silver-molybdenum-oxygen compounds, silver-antimony-oxygen compounds and silver-germanium-oxygen compounds. Although silver-antimonate and silver-molybdate belong to this class of compounds which are known to form in a silver-tin-oxide-molybdenum-oxide and/or a silver-tin-oxide-antimony-oxide material and to have no favorable influence on the wetability of tin oxide (see Christine Bourda's paper referenced above), one has achieved with the contact material according to the invention, a significantly lower temperature increase on the contacts under continuous current as compared with known contact materials with comparable weight composition. It is suspected that the reason for this can be found in the contact material not being produced in the usual manner by mixing and sintering silver powder, tin oxide powder and additional metal oxide powders, but, by starting out with a powder which contains, instead of a pure metal oxide such as, e.g., $MoO_3$, a compound of type silver-metal-oxygen such as $Ag_2MoO_4$, especially when this compound is completely or partially combined with tin oxide powder particles, forming a compound powder in whose particles tin oxide and the silver-metal-oxygen compound are combined; this compound powder is then mixed with silver powder and sintered into a contact material. Significant advantages are achieved in the powder metallurgical production of the contact material according to the invention, by mixing silver powder with a powder consisting mainly of tin oxide and one or more compounds of type silver-oxygen-metal. Surprisingly, it turned out that with the contact material according to the invention a certain lowering of the contact temperature under given conditions could be achieved with a significantly smaller portion of the chosen admixtures than hitherto possible with known technology. First experience with the contact materials according to the invention shows that a certain reduction of the contact temperature can be achieved, according to the invention, with only ½ to 1/10 of the admixture quantity necessary to achieve the same temperature reduction with hitherto known technology. This is also true for the example of molybdenum oxide whose share can be drastically reduced when replaced by silver-molybdate, especially when combined with tin oxide particles.

This also results in a less brittle, i.e. more ductile contact material. A further advantage is the fact that because of the lower share of non-conductive admixture, the electric resistance of the contact material is additionally lowered contributing additionally to a lower contact temperature.

A further advantage of the invention is the fact that because of the lower share of admixture, the life span of contact pieces made from the contact material is increased, especially under AC1test conditions. The utilization of the powder according to the invention yields a lower burning off compared with conventional silver-tin oxide contact materials using pure metal oxide admixtures such as tungsten oxide, molybdenum oxide or bismuth oxide.

DESCRIPTION OF THE PREFERRED EMBODIMENT

The tin oxide particles are preferably coated with a layer of silver-metal-oxygen compounds. They effectively promote wetting of tin oxide particles with the liquid phase generated by arc. A tin oxide powder modified in this manner can be made advantageously by mixing tin oxide powder with powdered admixture and annealing the mixture so that tin oxide powder particles are wetted by the admixture whereby a part of the admixture diffuses into the surface of the tin oxide particles, possibly forming a mixed oxide there.

In order to safeguard sufficiently against fusing of contact pieces, as required of silver-tin oxide materials, the material contains 5 to 20 weight %, preferably 8 to 14 weight % tin oxide, and, in order for tin oxide to remain in suspension when melted under the influence of electric arc, as desired, tin oxide should contain a minimum of 0.1 weight % admixtures, but not more than 2.5 weight %, and best not more than 1 weight %.

A particularly preferred admixture is silver-molybdate, because of its very favorable effect on thermal behavior.

Annealing the mixture of tin oxide and the selected admixture is best carried out under an oxygen containing atmosphere, preferably air, at a temperature of between 500 deg. C. and 800 deg. C., the best temperature being just above the melting point of the admixture, so that the admixture is liquefied and can wet the surfaces of the tin oxide particles. The admixture is thus deposited only where its favorable wetting effect is desirable, and can therefore be utilized without waste. Considering the small quantities with which it is used, the tin oxide particles do not stick together; but should this occur on rare occasions, then the material can be ground down.

Tin oxide and admixture can be combined not only through annealing but also through deposition of the admixture on tin oxide particles through application of chemical and physical separation processes.

The teaching contained in this patent can be applied to contact materials based on silver with zinc oxides. In these materials admixtures have so far not been used in practice. One rather tries to reduce contact temperatures in switching equipment through design measures. Through application of an admixture in the zinc-oxide powder according to the invention, a lowering of the the contact temperature is possible with this type of material also.

EXAMPLES

Example 1

With 100 parts by weight tin oxide powder with particle size <7 mm according to FSSS (FSSS=Fisher Sub-Sieve Sizer) and 0.5 parts by weight di-silver-mono-molybdate $Ag_2MoO_4$ of similar or equal particle size, a powder mixture is produced by dry mixing. This powder mixture is placed in shallow ceramic dishes and annealed in air at 600 deg. C. for the duration of 1 hour, thereby wetting the tin oxide powder with $Ag_2MoO_4$. 12 parts by weight of the annealed mixture are mixed with 85 parts by weight silver powder with approximate particle size of 20 mm (FSSS value). The mixture is cold-isostatically pressed into a block under 200 MPa pressure, and subsequently sintered in air at 700 deg. C. for 2 hours. The sintered block is forward extruded into a 5 mm thick string. The string is then flattened through hot rolling thereby producing a solderable silver backing, then, through cold rolling, given the final thickness. From this strip contact platelets can be formed, as required, through shearing, stamping or saw cutting.

Example 2

A mixture is produced by dry mixing using 100 parts by weight tin oxide powder with particle size <7 mm (acc. to FSSS) and 1 part by weight silver-tetra-tungstate $Ag_8W_4O_{16}$ of similar or equal particle size. This powder mixture is placed in flat ceramic dishes and annealed in air for approximately 1 hour at 700 deg. C., thereby wetting the tin oxide powder with $AG_8W_4O_{16}$. 10 parts by weight of the annealed mixture are mixed with 90 parts by weight silver powder with a particle size of approx. 20 mm (acc. to FSSS). The mixture is cold-isostatically pressed into cylindrical blocks under 200 MPa pressure and sintered in air for the duration of 2 hours at 700 deg. C.

The sintered block is encased in silver, inserted hot into a backward extrusion press (DE-OS 34 26 240). This process yields flat strips which have a solderable and weldable silver surface on one side. The final desired thickness is obtained through cold rolling. From this band contact platelet can be made, as required, through shearing, stamping or saw cutting.

Example 3

Example 1is modified in that 119.5 parts by weight tin oxide powder with particle size smaller than 7 mm and 0.5 parts by weight $Ag_2MoO_4$ with a medium particle size of 40 mm are mixed and annealed at 600 deg. C. In this process $Ag_2MoO_4$ is spread to the tin oxide particles. The remainder of the procedure is the same as in example 1.

Contact pieces produced in this manner are tested for life span according to test category AC1in a switching equipment having power output of 37 kW. After 200,000 switching operations the life time test was interrupted for a check on the temperature rise of the contact pieces under continuous current. It could be shown that the temperature rise with 70 to 90 deg. K in the average was not higher than for a conventionally produced material of composition Ag88/$SnO_2$11.6/$MoO_3$0.4 containing approximately 10 times as much molybdenum-oxide.

The three examples can be modified in that tin oxide is replaced by zinc-oxide.

We claim:

1. A process for the production of a material for electric contacts on the basis of silver-tin oxide comprising the steps of:

mixing tin oxide powder and an additional powder, the weight % of the additional powder is 0.01 to 10 weight % of the weight % of tin oxide, said additional powder comprises at least one compound consisting of silver, oxygen and a metal selected from the group consisting of Sub-groups II to VI of the Periodic Table, antimony, bismuth, germanium, indium and gallium;

annealing the mixture;

mixing said annealed mixture with a silver or silver based alloy powder forming a mixture comprising 5–20 weight % tin oxide, the weight % of the additional powder is 0.01–10 weight % of the weight % of tin oxide, and the remaining weight % of the mixture comprises silver or silver based alloy powder;

compacting the mixture; and sintering the mixture.

2. The process according to claim 1, wherein the mixture is annealed in air.

3. The process according to claim 1, wherein the mixture is annealed at a temperature range between 500 degrees C. and 800 degrees C.

4. The process according to claim 1, wherein the mixture is annealed at a temperature above the melting temperature of the additional powder.

5. The process according to claim 1, wherein the material is compacted again after sintering and further re-shaped.

6. A process for the production of a material for electric contacts on the basis of zinc oxide comprising the steps of:

mixing zinc oxide powder and an additional powder, the weight % of the additional powder is 0.01 to 10 weight % of the weight % of zinc oxide, said additional powder comprises at least one compound consisting of silver, oxygen and a metal selected from the group consisting of Sub-groups II to VI of the Periodic Table, antimony, bismuth, germanium, indium and gallium:

annealing the mixture;

mixing said annealed mixture with a silver or silver based alloy powder forming a mixture comprising 5–20 weight % zinc oxide, the weight % of the additional powder is 0.01–10 weight % of the weight % of zinc oxide, and the remaining weight % of the mixture comprises silver or silver based alloy powder;

compacting the mixture; and sintering the mixture.

7. The process according to claim 6, wherein the mixture is annealed in air.

8. The process according to claim 6, wherein the mixture is annealed at a temperature range between 500 degrees C. and 800 degrees C.

9. The process according to claim 6, wherein the mixture is annealed at a temperature above the melting temperature of the additional powder.

10. The process according to claim 6, wherein after the sintering mixture is compacted again and further re-shaped.

* * * * *